US007490950B1

(12) United States Patent
Meyers

(10) Patent No.: US 7,490,950 B1
(45) Date of Patent: Feb. 17, 2009

(54) SIMULATED CHRISTMAS TREE DECORATION

(75) Inventor: Paul E. Meyers, Minneapolis, MN (US)

(73) Assignee: Maravarr Dream Incorporated, Minneapolis, MN (US)

( * ) Notice: Subject to any disclaimer, the term of this patent is extended or adjusted under 35 U.S.C. 154(b) by 19 days.

(21) Appl. No.: 11/625,475

(22) Filed: Jan. 22, 2007

(51) Int. Cl.
*F21S 6/00* (2006.01)

(52) U.S. Cl. ..... 362/123; 362/252; 362/806

(58) Field of Classification Search ..... 362/123, 362/249, 250, 252, 391, 418, 432, 806, 807; 428/8, 9, 18, 19, 20
See application file for complete search history.

(56) References Cited

U.S. PATENT DOCUMENTS 3,163,574 A * 12/1964 Tong ..... 428/20
4,145,731 A 3/1979 Adamich
5,336,536 A * 8/1994 Oberzan ..... 428/8
5,359,502 A * 10/1994 Cantin ..... 362/123
6,048,590 A 4/2000 Phillips
6,132,063 A 10/2000 Byers
6,379,021 B1 4/2002 Shieh
7,152,998 B2 * 12/2006 Rahman ..... 362/252
7,311,421 B1 * 12/2007 Fahl ..... 362/250

OTHER PUBLICATIONS

"Installation for Spiral Light Tree Sculpture" Brochure, Seasonal Specialties, Inc., no date.

* cited by examiner

*Primary Examiner*—Y My Quach Lee
(74) *Attorney, Agent, or Firm*—C. G. Mersereau; Nikolai & Mersereau, P.A.

(57) ABSTRACT

A conical helix decorative Christmas tree with lights attached is supported either on a pole or a bracket extending from a wall. If a pole is used, the base may be in a tree stand or a bracket attached to a wall. In both embodiments the base of the helix has a circle aligned by a plurality of strings attaching the circumference of the circle to a washer at the radial center of the helix. More than one helix may be used in this manner to form the tree. A shroud may be used to add a translucent decorative effect. A topper of a star, angel or continuation of the conical tree to a point may be added at the top of the conical helix tree. The tree can be attached to horizontal or vertical surfaces.

18 Claims, 6 Drawing Sheets

SIMULATED CHRISTMAS TREE DECORATION

BACKGROUND OF THE INVENTION

I. Field of the Invention

This invention relates to holiday decorations. More particularly, this invention relates to devices and methods for mounting and supporting one or more coils of light supporting flexible material (such as plastic, metal or even wood) in a true conical or frusto-conical configuration to form a Christmas tree decoration and associated decorations attached thereto.

II. Related Art

Light supporting coils held in a generally frusto-conical helical shape have been used both inside and outside as holiday decorations. The coil is typically made of a flexible plastic material which, when not supported in a generally frusto-conical shape, lays flat on the ground or some other horizontal surface. To achieve a generally frusto-conical shape, the innermost portion of the coil which becomes the top of the decoration typically includes an attachment member then allows it to be attached to a support pole which projects up through the inside of the coil from a base. However, one problem with prior art Christmas decorations of this type is that they often appear lopsided and do not hang evenly from the pole.

For the most aesthetically pleasing simulation of a Christmas tree, it is desired to achieve a true frusto-conical or preferably a true conical shape and further to have a circular base some distance off the ground to simulate the lower branches of the tree. Prior art efforts to achieve this shape typically involve using strings to tie the bottom turn of the coil either to the legs of the support stand that support the center pole or to tie the lowermost coil to stakes in the ground. It is proven to be exceedingly difficult, however, to quickly and easily center the coil around the pole in this fashion and the result is a lopsided or uneven appearance. Another problem with prior art decorations of this type is that they typically can only be supported on a horizontal surface such as a floor or a flat piece of ground using a stand and pole arrangement. However, it is often desirable to support the decoration in some other way. For example, it may be desirable to mount and support the decoration to the top of a fence post, to a vertical surface such as a wall, a glass surface such as window or sliding glass door, column, or even to a surface that is not vertical. It may also be desirable to suspend the decoration from above such as from a ceiling or suspension cable extending over a street or the like. Thus, there is a real need in the art to provide alternative arrangements for supporting the decoration.

It is further desired for the decoration to have a conical (as opposed to a generally frusto-conical) shape to better simulate a Christmas tree and for other aesthetic reasons. In prior art devices, at best a frusto-conical shape was achieved because the top turn of the helical coil generally formed a circle coupled to the top attachment which engaged the top of the pole to support the decoration. This gives the decoration an appearance suggesting that the top of the tree had been cut off because the top two or three windings needed to complete a conical shape so that the decoration comes to a point are missing.

Still another problem with prior art devices of this type is that they are limited in their application. Possible applications of the prior art devices can be expanded by providing a translucent shroud or cover to produce a simulated tree having a diffused or glowing light effect.

Another real disadvantage with the commercially available prior art devices is that two people are recommended for assembly. It is desirable to provide a device that can be easily assembled by a single person.

SUMMARY OF THE INVENTION

The present invention provides important advantages over the prior art. These improvements provide a decoration that is easier to assemble, has a true frusto-conical or, preferably, a conical shape that is not lopsided or uneven, and can be supported from horizontal surfaces, vertical surfaces, or surfaces of any other orientation. A first improvement provided by the present invention is the inclusion of a bottom centering assembly attached to a circular, lowermost turn of the helical coil. The bottom centering assembly involves joining the two lowermost turns of the helical coil to form a circle. The bottom centering assembly further comprises three or more strings or spokes joining in securing a washer to the center of the bottom circular loop of the coil. When a floor stand and pole are used to support the decoration, the pole extends from the stand, through the hole in the center of the washer and to the top member that joins the top of the coil to the top of the pole. This arrangement ensures a true frusto-conical shape that is not lopsided or off-center. Likewise, the bottom centering assembly can cooperate with the top member to provide this true frusto-conical shape when other support mechanisms are used. Another truly significant advantage of the bottom centering assembly is that it can support the other turns of the coil in such a way that a single person can easily assemble the decoration for use.

Other improvements provided by the present invention relate to the available support mechanisms. In the prior art, the stands used to support the pole typically included a base and detachable legs. The present invention modifies the base so that it can be secured to any horizontal surface, including by way of example and without limitation, the top of a fence or railing and still support the pole in a vertical fashion. The present invention also modifies the detachable legs so that two of them can be attached to brackets mounted with appropriate vertical spacing on virtually any vertical surface such that the top leg can engage the top member of the decoration and the lower leg can engage the washer to hold the coil in a true frusto-conical shape.

Alternatively, a separate bracket having a coupling that permits it to be joined to the support pole may be used to support the helical Christmas tree decoration in a fashion similar to that described above. The bracket, of course, must support the pole in a vertical fashion. The bracket may be made adjustable so that it can be attached to a vertical surface, a horizontal surface, or other surfaces of differing angles.

Still another improvement provided by the present invention provides a conical rather than a frusto-conical shape. Specifically, a decorative topper can be added to the top of the tree decoration to convert the shape from frusto-conical to conical. The tree topper provides the last one or two turns required to provide a conical shape is joined to the top of the plastic coil and is also joined electrically and includes lights to complete the decoration. Also, the present invention provides a shroud of translucent material that can be placed over the helix to expand the possible applications of the decoration. Likewise, the possible applications of the decoration are expanded by providing multiple helical coils as opposed to a single coil and also by attaching lighting to the coil such that the light bulbs project perpendicularly from the coil either upwardly, downwardly, or both upwardly and downwardly.

OBJECTS OF THE INVENTION

It is an object of the invention to provide a bottom centering assembly at the base of the helical coil to provide a true frusto-conical or conical shape to the decoration.

It is an object of the invention to provide an alternative means for supporting the helical coil with respect to surfaces other than a floor or the ground.

It is an object of the invention to provide an improved pole supporting base which can be attached to legs for supporting the pole in a vertical fashion above a floor or the ground or which can be attached to the top of a fence or railing to support the pole in a vertical fashion.

It is an object of the invention to provide a bracket which can be secured to a non-horizontal surface that can support the pole in a vertical fashion.

It is an object of the invention to provide a bracket that is adjustable such that the bracket can vertically support the pole from a vertical surface or a surface of some other angular orientation.

It is still another object of the invention to provide a pair of brackets which can be joined to a vertical surface in a vertically spaced orientation such that they can be used to support two of the legs of the stand to support the coil in a frusto-conical or conical configuration without the need for a center pole.

It is an object of the invention to provide a top helix extension of the top of the Christmas tree.

It is an object of the invention to provide a decorative topper for the top of the Christmas tree.

It is an object of the invention to provide a shroud for diffusing the lights from the helix Christmas tree.

It is an object of the invention to provide a circularly symmetric helix for the helix Christmas tree.

It is an object of the invention to provide helix support mechanisms that include a support pole.

It is an object of the invention to provide support mechanisms that do not incorporate a support pole.

It is an object of the invention to provide and easy to assemble and disassemble helix Christmas tree.

It is an object of the invention to provide a support for a helix Christmas tree.

It is another object of the invention to easily erect the helix Christmas tree by one person who merely picks up the center disk from the flat coil and attaches it to a support.

It is another object of the invention to easily disassemble and store the helix Christmas tree by one person who merely removes the center disk from the support and lets the coil resume its flat disk storage shape.

Other objects, advantages and novel features of the present invention will become apparent from the following description of the preferred embodiments when considered in conjunction with the accompanying drawings.

DETAILED DESCRIPTION OF THE PREFERRED EMBODIMENT

Figure 1:
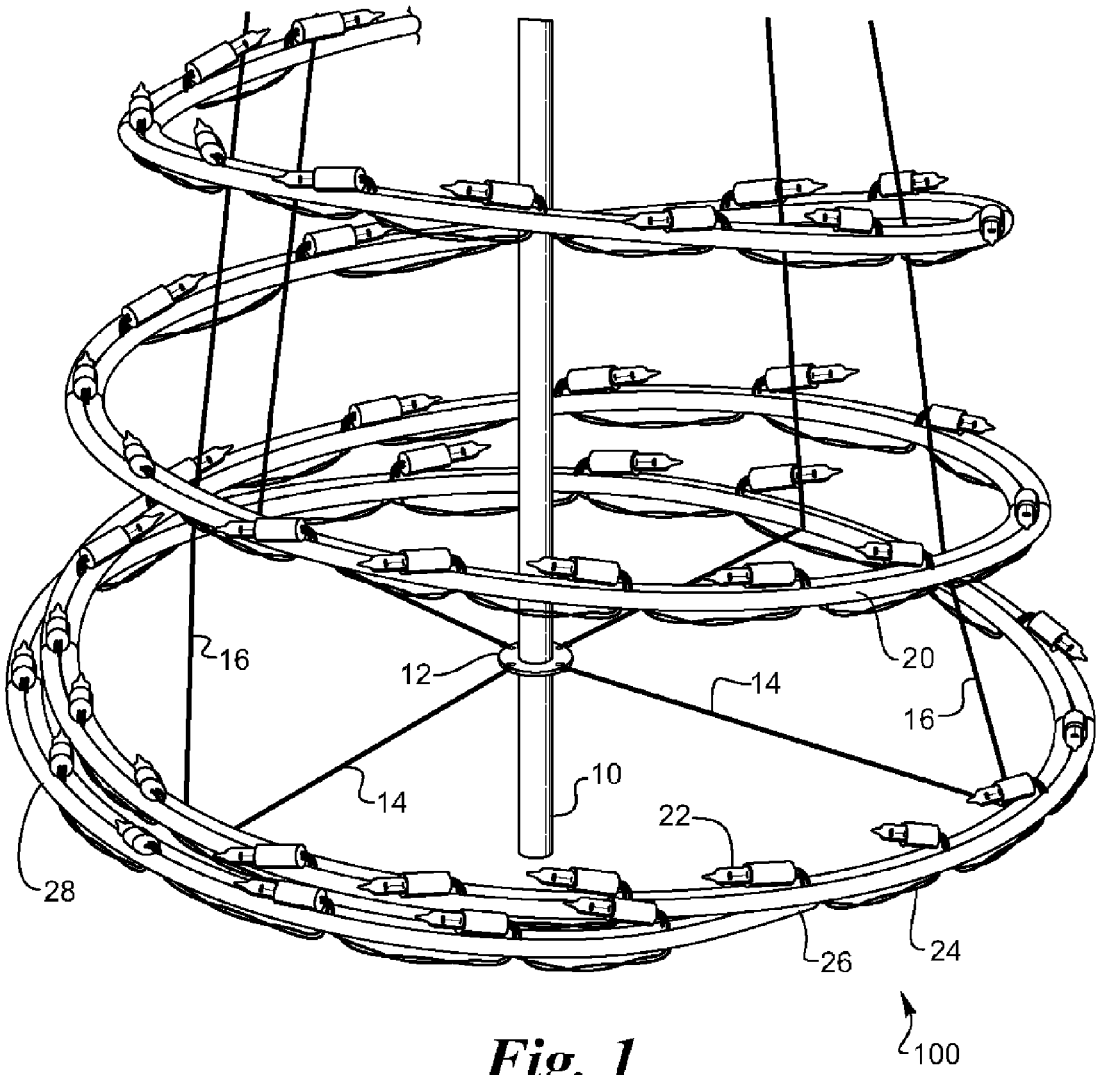
FIG. 1 is a perspective view of the circular base of the helix with central pole and washer and with strings from the washer to the circumference of the circular base to align the helix axially and radially.
Figure 2:
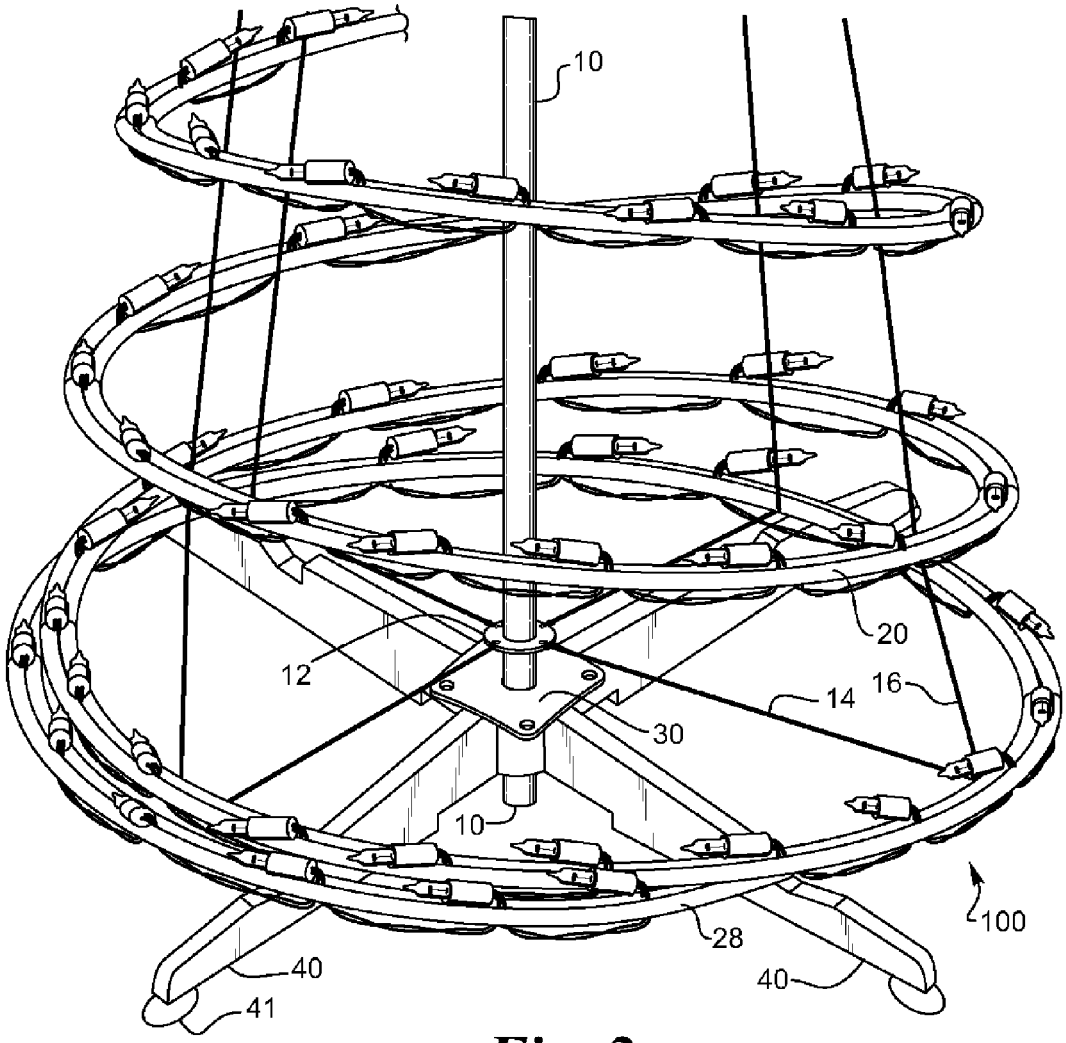
FIG. 2 is a perspective view of the circular base of the helix with the pole extending from a stand.

FIGS. 1 and 2 are provided to show the bottom portion of the present invention. As shown in these drawings, the invention includes a coil 20 made of a plastic material. While a single coil is shown in the drawings for simplicity, multiple coils can be used. Thus, the term "coil" refers not only to a single coil of material but also arrangements including multiple coils of material. The helical coil 20, which may actually include one or more coils, is designed to support lights 22 and associated wiring 24. As shown in FIGS. 1 and 2, the lights 22 are all oriented in the same way lying flat along the coil 20. However, alternative orientations of the lights 22 may be used. For example, the lights 22 can point in an upward direction perpendicular to the plastic material as shown in FIGS. 6-10, point in a downward direction perpendicular to the plastic material, or both. Likewise, the coil 20 can be formed of so-called rope lights. Rope lights typically comprise a hollow translucent or transparent plastic tube having wiring and lights positioned along the length of the tube. The lights 22 may be of any color. The lights 22 can include incandescent bulbs or, alternatively, light emitting diodes.

When the decoration of the present invention is not in use or packaged for shipment, the coil 20 is designed to lay flat. However, when in use, the centermost portion of the coil 20 is pulled up from the outermost portion of the coil to form a generally frusto-conical helical shape. To obtain and retain this shape, various elements are added to the coil. As shown in FIGS. 1 and 2, a bottom centering assembly is provided. The bottom centering assembly comprises a washer 12 coupled to the bottom circular loop 28 of the coil by a plurality of radial connections 14 which extend between and connect the washer 12 to the bottom circular loop 28 of the coil. These radial connections 14 are typically in the form of a string or wire and serve to retain the washer 12 at the center of the circular loop 28. The bottom loop ends at connection point 26 with the end of the helix attached to the last loop to form a circle at the bottom of the helix. The end of the helix can be connected to the loop by any kind of fastener including a plastic fastening including a universal tie strap, tape or any other means of fixing the end of the helix to a portion of the helix to form a circle at the bottom of the helix.

Also shown in FIGS. 1 and 2 are a plurality of vertical spacing members 16. These members ensure that proper spacing exists between the turns of the coil 20 when in its frusto-conical form. The vertical spacing members 16 can be made of any suitable material and are tied or clamped to each turn of the coil 20 to ensure proper vertical spacing between the turns. Ideally, members 16 arc designed so the spacing can be easily set and adjusted. This can be achieved by having a plurality of spheres spaced along the members 16 that mate with clamps secured to the coil. The spacing provided depends upon which sphere is mated with a particular clamp.

Figure 8:
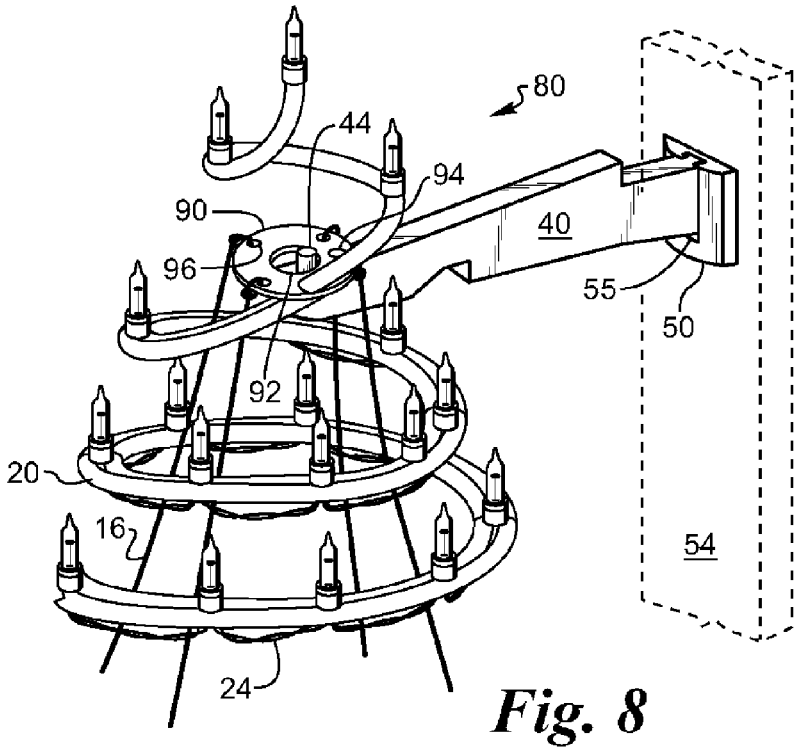
FIG. 8 is a perspective view showing the top leg, top of the helix and top helix extension.
Figure 10:
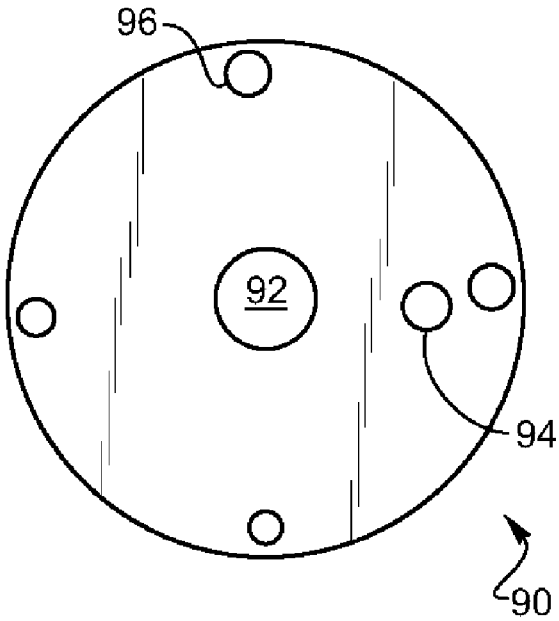
FIG. 10 shows a top view of the top disk.

Other drawings, for example FIG. 8, show a disk 90 which is attached to the innermost turn of the coil and forms a top support. This disk 90, as seen in FIG. 10, includes a catch 92 at its center as well as other holes 96 for attaching the vertical spacing members 16 and an alignment opening 94.

One way to support the decoration of the present invention above a floor or level ground is through the use of a pole and stand arrangement. When this arrangement is used, a pole 10, supported at its bottom end by the stand, passes through the washer 12. See FIG. 2. The top end of the pole is coupled to the disk 90 using catch 92.

Figure 3:
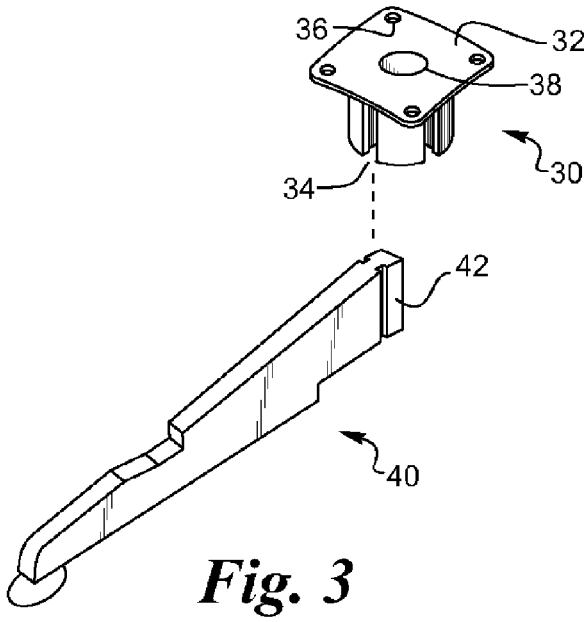
FIG. 3 is a perspective view of the center receiver for the legs and pole with a leg attached.
Figure 4:
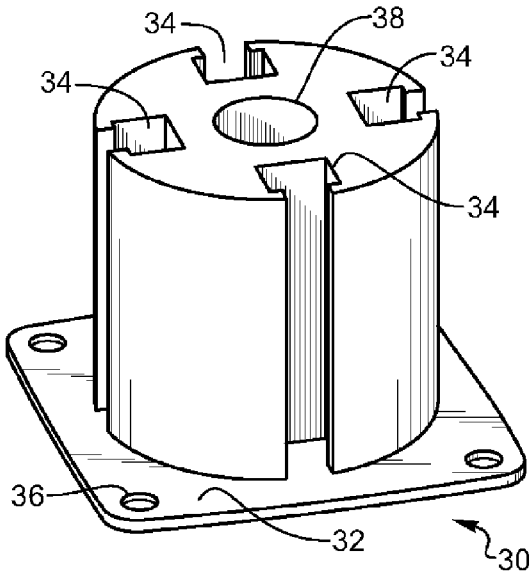
FIG. 4 is a perspective view of the center receiver.
Figure 5:
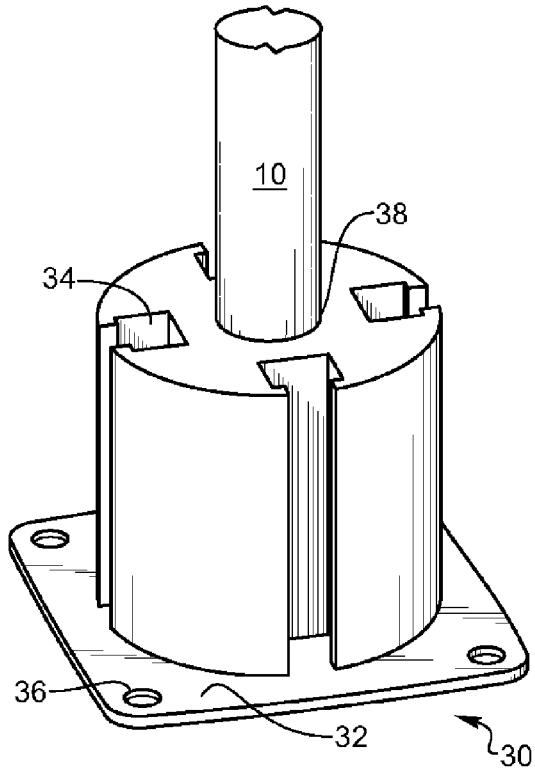
FIG. 5 is a perspective view of the center receiver with a pole inserted.

The pole supporting stand includes a base 30 and a plurality of legs 40 which are removably connected to the base 30. The legs 40 may have feet 41 attached. The base 30 is best shown in FIGS. 3, 4 and 5. As shown, the base 30 includes a flat mounting flange 32. Passing through the flat mounting flange 32 and the base 30 is a central aperture 38. The base 30 also includes a plurality of channels 34 which cooperate with projections 42 on the legs 40 to join the legs 40 to the base 30.

To assemble the decoration using the stand and pole arrangement, the legs 40 are joined to the base 30 and the pole 10 is inserted into the central aperture 38 of the base 30. The legs 40 and base 30 thus cooperate to hold the pole 10 in a vertical upright fashion. Next, the washer 12 is passed over the top of the pole 10 and the catch 92 of the disk 90 is coupled to the top of the pole 10. To prevent the coil 20 from spinning in such a way that may stress or even unplug the electrical cable powering the light, at least one hole 94 is provided in disk 90. These holes can mate with corresponding stationary pins 44 on the legs 40. (The holes 96 shown in FIG. 10 are used to secure the vertical spacing members 16 to the disk 90). As the washer 12 slides down the pole 10, the coil 20 transitions from a flat coil to a frusto-conically shaped coil. The disk 90 and the bottom centering mechanism consisting of the washer 12 and the radial members 14 ensure that the coil 20 is centered about the pole 10. The vertical spacing members 16 ensure proper spacing between the turns of the coil 20 to provide a true frusto-conical helical shape.

To convert the shape of the coil 20 from a frusto-conical helical shape to a conical helical shape, a topper 80 can be provided as in FIG. 8. The topper 80 comprises one or more short conical coil(s) having a base that approximates the size of the disk 90. The topper is mechanically coupled to the coil 20 to convert the appearance of the decoration from that of a frusto-conical shape to a conical shape. Lights are provided on the topper 80 which are electrically coupled to the lights 22 associated with the coil 20 to complete the overall appearance.

Figure 6:
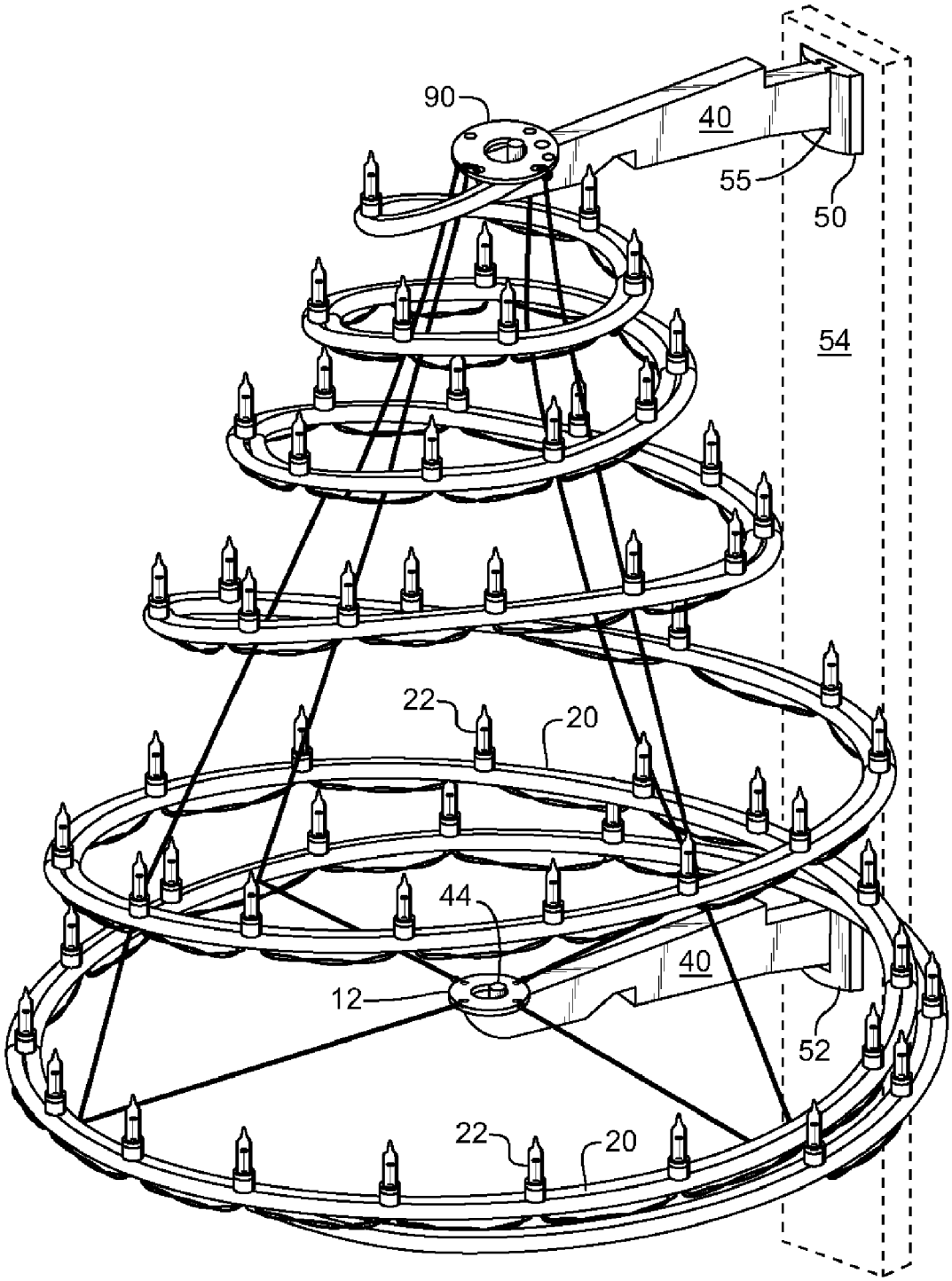
FIG. 6 is a perspective view of the helix with side receivers for legs mounted to a vertical support.

The topper 80 may be an integral part of the helix coil 20 or a plug-in addition to the helix coil. Disk 90 may be integrally part of the coil 20 with the topper 80 or without the topper 80 which may plug in and attach to disk 90. FIG. 6 shows the coil 20 ending at disk 90 providing an optional topper to be added. FIG. 8 shows the topper 80 which could be an addition or part of the coil 20. The topper 80 may be a continuation of the helix to come to a conic point at the top or alternatively a star, angel or other decoration.

One advantage of the base 30 of the present invention is the inclusion of the flat mounting flange 32 and the holes 36 through the flange 32. The outside dimensions of the outer flange 32 are typically about 9 cm by about 9 cm such that the flange 32 can sit on top of a fence post, railing post, or a cross piece to a railing. When the flange 32 is placed on top of the fence post or the like with the base 30 projecting upright from the flange 32. Screws or nails can be passed through the holes 36 to secure the base 30 in place. The pole 10 can then be inserted into the central aperture 38 of base 30 (see FIG. 5) and the coil 20 can be joined to and supported by the pole as described above. The bottom centering assembly comprised of the washer 12 and radial connections 14 and the top disk 90 ensure that the coil 20 is centered around the pole 10 and properly supported.

Another advantage of the base 30 relates to its use when the decoration is positioned outside on the ground. The pole 10 can be driven into the ground. The base 30 is then slid over the pole and stakes can also be driven into the ground through the holes 36 in the base to provide stability and prevent the pole from leaning.

Figure 7:
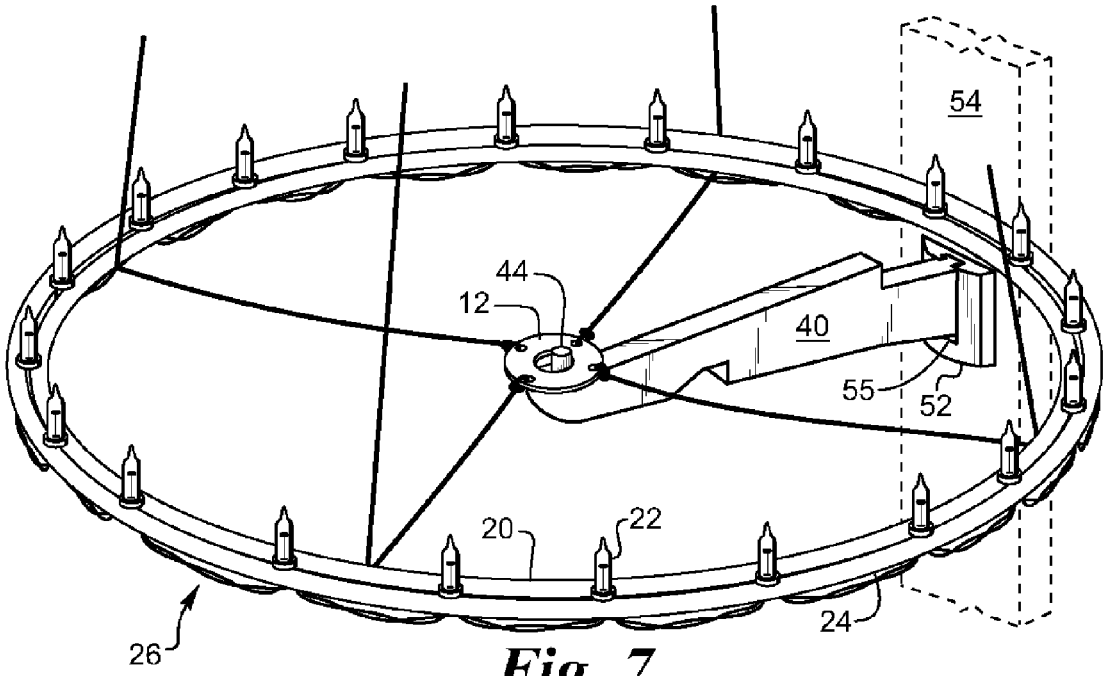
FIG. 7 is a perspective view showing the side receiver and bottom leg mounted to a vertical support.

At times, it may be desirable to support the coil 20 in its frusto-conical fashion from a vertical (as opposed to a horizontal) surface. When this is the case, a pair of brackets 50 and 52, as shown in FIGS. 6 and 7, are mounted to the vertical surface 54. These brackets can be attached in any number of ways depending on the nature of surfaces 54. By way of example and without limitation, nails, screws, suction cups, adhesives, or a hook and loop type mechanism could be used to attach the bracket. Like the base 30, each of these brackets 50, 52 have slots 55 designed to receive projections 42 associated with the legs 40. One of the legs 40 is inserted in an upside down fashion into the top bracket 50 such that its leg post 44 projects upwardly. Another leg is inserted in a similar fashion to the lower bracket 52. The leg post 44 of the upper leg 40 is then inserted into the catch 92 of the top disk 90 to secure the upper leg to the top disk. In a similar fashion, the leg post 44 of the lower leg is inserted into the hole in the washer 12, thus securing the coil 20 and the associated lights in a frusto-conical fashion. See FIGS. 6-8. One skilled in the art will recognize that the distance between the two brackets 50, 52 should be such that the coil is retained in a fully extended frusto-conical shape. To complete the decoration, and as shown in FIG. 8, the topper member 80 can be joined to the assembly as described above. When the above-described technique for mounting the decoration is used, a space exists between the vertical surface and the coil 20. Another decoration such as a sign or banner can be suspended from the upper leg 40 in this space if desired.

Figure 9:
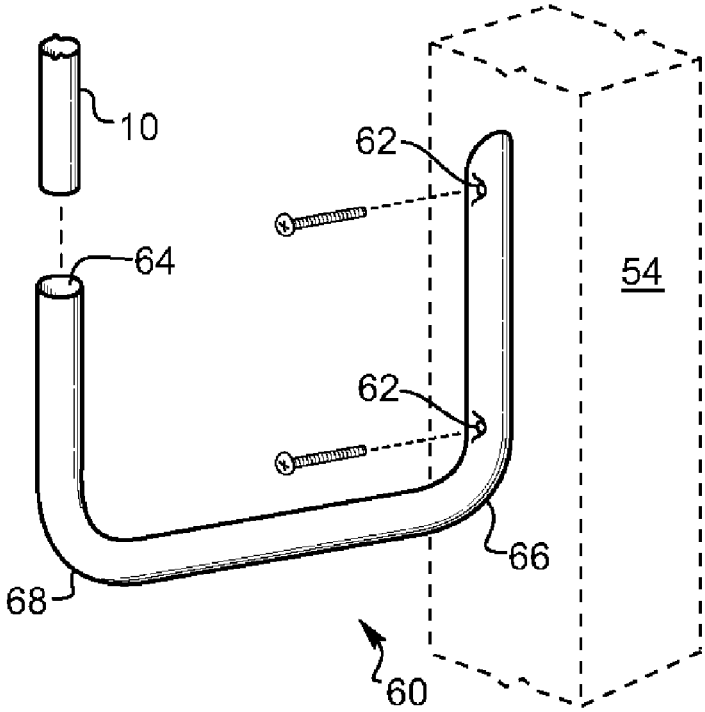
FIG. 9 is a perspective view showing the U shaped bar side mounting.

FIG. 9 shows an alternative arrangement for mounting the decoration to a vertical surface. Specifically, a U-shaped bracket 60 is provided. The portion of the U-shaped bracket 60 to be secured to the vertical surface includes a pair of holes 62 such that the bracket 60 can be screwed or nailed to the vertical surface. The other end of the U-shaped bracket 60 includes an orifice 64 into which the bottom of the pole 10 can be inserted. Once the pole 10 has been inserted into the orifice 64, the rest of the decoration is assembled as described above.

Those skilled in the art will recognize that most surfaces to which the decoration would be mounted will either be vertical or horizontal. However this is not always the case. Surfaces residing at a different angle than horizontal or vertical can be easily accommodated. First, the angle of the two bends 66 and 68 in bracket 60 are shown as generally 90°. When the bracket 60 is used with a surface other than a vertical surface, bends 66 and 68 of bracket 60 can be adjusted to accommodate the differing orientation of the surface to which the bracket 60 is mounted so that the pole 10 will be held in a vertical fashion irrespective of the angle of the surface to which the bracket 60 is mounted.

While various brackets have been shown and described above, other brackets can also be used. For example, a zip type strap often used by electricians to bundle wires can be used to couple the legs to a pole. A hose clamp could also be used for this purpose. When such brackets are used, they slide through a hole in the leg and are wrapped around the pole to secure the leg to the pole.

No matter which of the above-described techniques is used to mount the decoration, the result is a true frusto-conical helical shape (or a conical shape if the topper is used) that is aesthetically pleasing. A final improvement provided by the present invention is the inclusion of a translucent covering or shroud that can cover the conical or frusto-conical helical shape so that when power is applied to illuminate the lights, the effect is a generally uniform glowing appearance. This shroud can be made of a lightweight plastic and can be colored to increase the decorative properties of the artificial Christmas tree 100. Of course, the shroud must be sufficiently heat resistant to withstand any elevated temperatures produced by the bulbs when they are illuminated.

What is claimed is:

1. A support for a conical helical coil lighting decoration comprising:

a spiral of plastic material having wires and lights along its length, having a central end and a distal end, an intervening conical spiral, an axially central axis, and having a loop of material forming a circle at the distal end, with the distal end attached to the spiral forming a fixed circumference circle, a plurality of radial connections extended from the loop of material and connected to a washer at an axial center of the spiral, a top support disk centered radially on the axial center of the spiral and connected to the central end of the spiral of plastic material, a plurality of vertical spacing members connecting the loop of material on the circle at the distal end to the top support disk and connected to the intervening conical spiral of material on a line between the distal end circle and the top support disk to support and space the spiral of plastic material in a conical shape.

2. A support for a conical helical coil lighting decoration as in claim 1 having, a top support for holding the top support disk on the axis of the conical he spiral of material, and;

a bottom support for holding the washer on the axis of the conical helix of material.

3. A support for a conical helical coil lighting decoration as in claim 2 having, a top decoration attached to the top support disk.

4. A support for a conical helical coil lighting decoration as in claim 3 wherein, the top decoration is a continuation of the conical spiral to the central end on the axis of the conical spiral.

5. A support for a conical helical coil lighting decoration as in claim 2 having, a base with a central aperture, a pole extending from the central aperture, with the washer encircling the pole for aligning the axis of the spiral of plastic material, and the top disk axially centered and attached to a top of the pole.

6. A support for a conical helical coil lighting decoration as in claim 5 wherein, the top support is a horizontal bracket attached to a vertical support and the bottom support is a horizontal bracket attached to the vertical support.

7. A support for a conical helical coil lighting decoration as in claim 6 having, a top decoration attached to the top support disk.

8. A support for a conical helical coil lighting decoration as in claim 5 having, a top decoration attached to the top support disk.

9. A support for a conical helical coil lighting decoration as in claim 2 wherein, a base is having legs for supporting the base in an upright position when resting on the floor.

10. A support for a conical helical coil lighting decoration as in claim 9 wherein, the base has apertures for attaching the base to an object with fasteners.

11. A support for a conical helical coil lighting decoration as in claim 10 having, a top decoration attached to the top support disk.

12. A support for a conical helical coil lighting decoration as in claim 9 having, a top decoration attached to the top support disk.

13. A support for a conical helical coil lighting decoration as in claim 2 wherein, a U shaped bracket having a first arm attached to a vertical support and a second ann with a vertical pole holding portion for supporting a pole vertically with the washer encircling the pole for aligning the axis of the spiral of plastic material, and the top disk axially centered and attached to a top of the pole.

14. A support for a conical helical coil lighting decoration as in claim 13 having, a top decoration attached to the top support disk.

15. A support for a conical helical coil lighting decoration as in claim 1 wherein, a plurality of spiral helixes of material are used on the axially central axis.

16. A support for a conical helical coil lighting decoration as in claim 15 having, a top decoration attached to the top support disk.

17. A support for a conical helical coil lighting decoration as in claim 2 wherein, a plurality of spiral helixes of material are used on the axially central axis.

18. A support for a conical helical coil lighting decoration as in claim 17 having, a top decoration attached to the top of the top support disk.

* * * * *